United States Patent [19]

Hoffman et al.

[11] Patent Number: 4,597,332

[45] **Date of Patent: * Jul. 1, 1986**

[54] CHAFF DISPENSER FOR ATMOSPHERIC RE-ENTRY

[75] Inventors: Leonard M. Hoffman, Burlingame; John B. Kimball, Menlo Park, both of Calif.

[73] Assignee: The United States of America as represented by the Secretary of the Navy, Washington, D.C.

[ * ] Notice: The portion of the term of this patent subsequent to Aug. 1, 2001 has been disclaimed.

[21] Appl. No.: 415,830

[22] Filed: Dec. 3, 1964

[51] Int. Cl.[4] ..... F42B 13/00

[52] U.S. Cl. ..... 102/505; 102/351

[58] Field of Search ..... 102/49, 495, 34.4, 35.6, 102/37.6, 63, 89, 505; 89/1.5

[56] References Cited

U.S. PATENT DOCUMENTS 3,095,814 7/1963 Jansen et al. ..... 102/377

3,225,654 12/1965 Barr et al. ..... 102/351 X

*Primary Examiner*—David H. Brown

*Attorney, Agent, or Firm*—Robert F. Beers; Kenneth E. Walden

[57] ABSTRACT

The invention proposes the launching or re-entry pods, individually or in groups, from a launching platform, so directed as to precede the entering body throughout the atmospheric trajectory, and containing therein chaff material or bundles to be dispensed therefrom at programmed intervals whereby the chaff material is scattered over a larger area ahead of the entering body so that receiving radar will track the chaff material rather than the body, thus confusing during the atmospheric re-entry of the body.

8 Claims, 3 Drawing Figures

CHAFF DISPENSER FOR ATMOSPHERIC RE-ENTRY

This invention relates to chaff dispensing apparatus and more particularly to means and apparatus for dispensing chaff and radar counter-measure reflective matter deep into the atmosphere in front or directly ahead of missiles re-entering the atmosphere at hypersonic velocities.

More specifically, the invention proposes the launching of re-entry pods, individually or in groups, from a launching platform, so directed as to precede the entering body throughout the atmospheric trajectory, and containing therein chaff material or bundles to be dispensed therefrom at programmed intervals whereby the chaff material is scattered over a large area ahead of the entering body so that receiving radar will track the chaff material rather than the body, thus confusing any search radar screen picture for the radar observer during the atmospheric re-entry of the body.

Accordingly, it is an object of the present invention to provide a device capable of dispensing chaff bundles deep into the atmosphere while re-entering at hypersonic velocities.

Another object of the invention is to provide a chaff dispensing device of the type described which is adaptable for using different bundle length storage and established pyrotechnic ejection methods to satisfy detail environmental and storage capacity requirements.

A further object of this invention is to provide such a dispensing device in which chaff, bundled into various lengths, can be deployed so that the longest bundles are ejected at the highest altitudes.

Yet another object of the present invention is to provide a device of the type described which will automatically eject quantities of radar reflecting chaff into the atmosphere at programmed intervals, until all the chaff stored therein has been expended, while re-entering at hypersonic velocities.

Other objects and many of the attendant advantages of this invention will be readily appreciated as the same becomes better understood by reference to the following detailed description when considered in connection with the accompanying drawings in which like reference numerals designate like parts throughout the several figures thereof and wherein.

Figure 1:
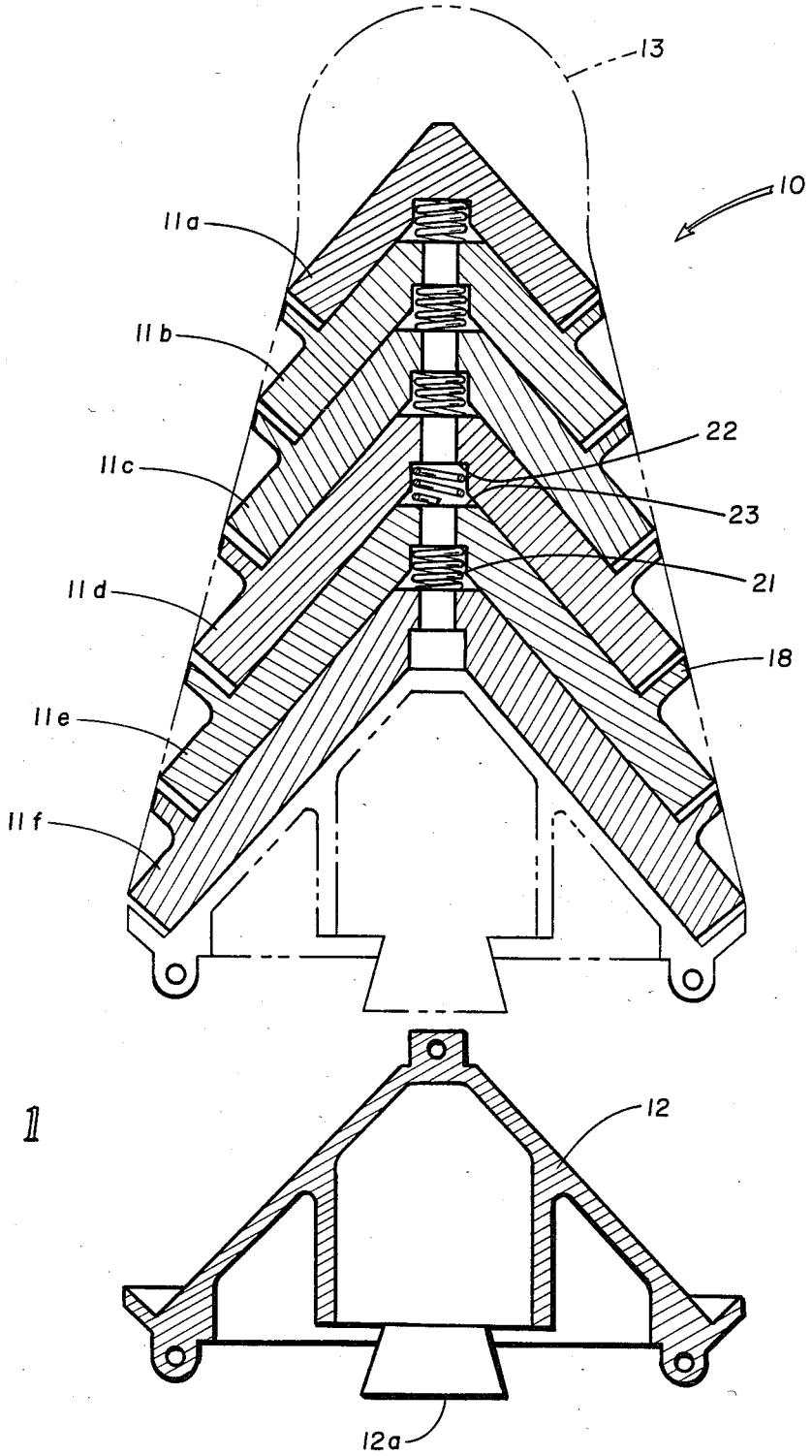
FIG. 1 is a cross-sectional view of a chaff-dispensing re-entry pod formed in accordance with the present invention.

Referring now to the drawings and more particularly to FIG. 1, a re-entry pod, adapted to be launched from a launching platform, is generally designated by the numeral 10 and is composed of a plurality of substantially truncated come-shaped pod segments 11, a motor-mount section 12 at the rear portion thereof and a protective outer coating 13 of a suitable ablative material at the nose portion thereof. Each of the pod segments 11 carries a different length chaff bundle and the pod segments are of varying structural dimensions in accordance with the length of chaff bundle to be carried therein. The pod segments are positioned one within the other in serial interlocked relationship with the smallest segment 11*a* near the apex portion of the substantially cone-shaped re-entry pod 10, adjacent the ablative nose portion 13, and the largest segment 11*f* adjacent the cone open-end interlocked with the motor-mount section 12 so that, when operative, the largest segment will be the first to dispense its payload, then the next largest, and so on until all the segments have been separated and all the chaff material contained therein has been dispensed. With this device it may be seen that the chaff material, bundled into various lengths, can be effectively deployed such that the longest bundles are ejected at the highest altitudes. Although six pod segments 11*a*, 11*b*, 11*c*, 11*d*, 11*e* and 11*f* are shown contained within re-entry pod 10, it is to be understood that any desired number of segments within the designed criteria of the device could be utilized equally as well.

Figure 2:
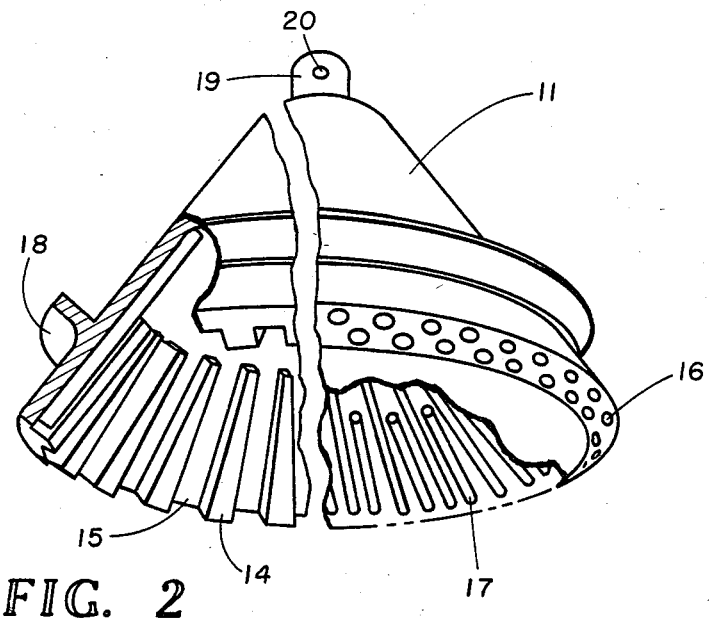
FIG. 2 is a somewhat fragmentary diagrammatic side elevation, partly in section, of a pod segment embodied by this invention.

Referring now to FIG. 2 showing the structural detail of the pod segments, it may be seen that each segment is constructed so that it is provided with a plurality of internal and integral channel-defining shoulder elements 14 about the peripheral portion of the cone-shaped pod segment 11 and near the conical open-end thereof. Positioned within the channels 15, thus defined, and adapted to be dispensed therefrom through end openings 16 are the chaff bundles 17 having the general configuration of small cylindrical rods. The pod segments dispense the chaff bundles 17 by established pyrotechnic ejection methods, utilizing a sequensor, which may be any suitable mechanical timing mechanism, for dispensing the bundles sequentially around the periphery of the pod segment.

Integral with the outer peripheral portion of the conical pod segment and extending thereabout is an upstanding flange 18 which is designed to mate with the end annular portion of the next succeeding pod segment and thereby to function as a protective cover for the undispensed chaff bundles contained within the channels of the succeeding segment, and at the apex portion is a stem 19 having an aperture 20 therein adapted to receive a pin (not shown) for providing retention of the pod segment until the chaff payload has been dispensed therefrom. The retaining pin may be connected with the next succeeding pod segment and is adapted to be pulled or removed from the aperture 20 in stem 19 concurrently with the pyrotechnic ejection of the last chaff bundle from the dispensing pod segment. The pin may be physically pulled from its retention position by the expelled bundle of chaff, or it may be destroyed or otherwise removed by the heat or blast developed from the pyrotechnic charge which ejects the bundle from its channel in the segment.

Once the retaining pin has been removed, ejection of the expended pod segment from the main re-entry pod is accomplished by a spring system, as highly compressed coil spring 21 positioned between successive pod segments in abutting relationship with shoulders 22 and 23 thereon.

Figure 3:
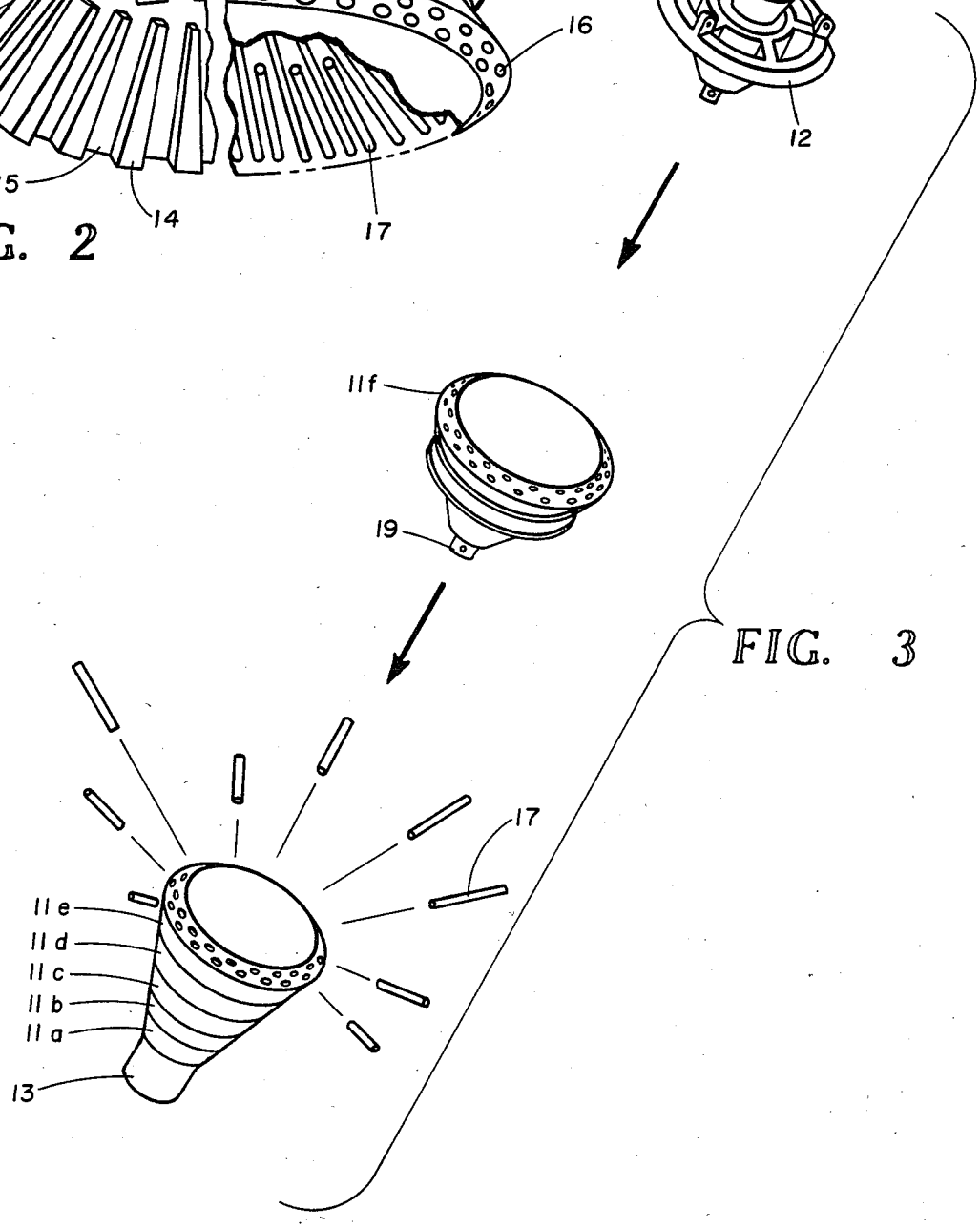
FIG. 3 is a fragmentary view of the re-entry pod of FIG. 1 illustrating the dispensing sequence of the chaff dispensing apparatus.

FIG. 3 of the drawings graphically illustrates the dispensing sequence of the apparatus, and the step-by-step operative proceedings of the apparatus may best be described by reference thereto. The re-entry pod or projectile is launched as aforedescribed from a launching platform and is directed to precede the entering body throughout the atomspheric trajectory. Upon approaching the dispensing altitude, the motor-mount 12 for the lift-off motor 12*a* is ejected and the first pod segment 11*f*, sealed until this mount by the motor mount, starts dispensing chaff bundles 17 sequentially around its periphery. When the last chaff bundle contained within the pod segment 11*f* had been expelled therefrom, a spring system within the main re-entry pod 10 acts to eject the expended segment therefrom, whereupon the second pod segment 11*e* starts dispensing its payload sequentially around its periphery in the same manner heretofore described. Pod segment 11*e* is then ejected and the process is continued at programmed intervals until all the pod segments have been expended.

Obviously, the dispersion effect achieved with the pod segmented feature of the present invention is enhanced by the sequential chaff bundle-dispensing system embodied therein, because of the unsymmetrical thrust thereby produced upon the main section of the re-entry pod. Also, the aftward ejection of the expended pod segments tends to add velocity to the remaining unexpended portion of the pod.

It may be observed that deeper atmospheric penetration is obtained by the novel division of the re-entry pod into segments, since the ballistic coefficient of the device is controlled by the reduction of the frontal area thereof as the expended pod segments are ejected. Moreover, radar detection is even further confused by the ejection of the expended pod segments.

Various modifications are contemplated and may obviously be resorted to by those skilled in the art without departing from the spirit and scope of the invention, as hereinafter defined by the appended claims, as only a preferred embodiment thereof has been disclosed.

What is claimed is:

1. A device for ejecting and dispensing chaff from a projectile which comprises:

a plurality of projectile segments positioned in serial-like contacting relationship to form the main structure of said projectile, retention means releasably connecting each segment to the next successive segment, each of said segments containing therewithin a plurality of chaff bundles, a motor for launching said projectile, a motor-mount for releasably coupling said motor to the rear end of said projectile, a nose section composed of an ablative material and connected to the forward end of said projectile, means for sequentially expelling the bundles from each of said segments and for releasing the corresponding retention means, whereby when said motor mount is released from said projectile, the bundles will be sequentially expelled from the aftmost segment and thereafter from each successive segment, as each segment is released from the projectile when it becomes expended of the chaff bundles contained therewithin, until all srgments within the projectile have dispensed all the chaff material contained therein.

2. The device of claim 1 including spring means within the projectile for expelling each segment therefrom when the segment has dispensed all the chaff bundles originally contained therewithin.

3. The device of claim 1 wherein the chaff bundles contained within each segment decrease in size progressively from the aftmost segment to the most forward segment, whereby the largest bundles are ejected from the projectile at the highest altitudes.

4. The device of claim 1 wherein the segments are substantially truncated cone-shaped and of respective different size, the largest being at the rear of the projectile and the smallest being at the front of the projectile.

5. The device of claim 4 wherein the chaff bundles contained within the segments vary in size according to the size of the segment, the longest bundle being in the largest segment and the shortest bundle being in the smallest segment, respectively.

6. The device of claim 4 wherein the chaff bundles are positioned about the peripheral portion of the cone-shaped segments, adapted to be sequentially dispensed therefrom around the periphery thereof.

7. A chaff dispensing pod device for dispensing chaff deep into the atmosphere while re-entering at hypersonic velocity, comprising:

a plurality of releasably interconnected pod segments, multiple chaff bundles contained within each of said pod segments, means for sequentially dispensing said chaff bundles from each of said pod segments, and programming means for actuating the chaff bundle-dispensing means of one of said pod segments, for releasing and ejecting from the pod device said one of said pod segments and each subsequent pod segment as it becomes fully expended of the chaff bundles therein contained, and for actuating the chaff bundle-dispensing means of another of the plurality of pod segments upon the release and ejection of any of said pod segments, until all the pod segments have been expended.

8. The chaff dispensing device of claim 7 wherein each of said plurality pod segments contains a set of chaff bundles different in size from that contained in any other pod segments, and wherein the provision in said programming means for actuating the chaff bundle-dispensing means of each of the pod segments includes means for sequencing the actuation thereof so that the pod segments will be actuated sequentially in accordance with the size of the chaff bundles contained therein, the pod segments containing the largest size chaff bundles being actuated first and so on, with the pod segment containing the smallest size chaff bundles being actuated last, whereby the largest bundles are dispensed from the device at the highest altitudes.

* * * * *